US006134871A

United States Patent [19]

Kishimura

[11] Patent Number: 6,134,871

[45] Date of Patent: Oct. 24, 2000

[54] INDIVIDUAL-SPINDLE-DRIVE TYPE TEXTILE MACHINE

[75] Inventor: Yuriko Kishimura, Kyoto, Japan

[73] Assignee: Murata Kikai Kabushiki Kaisha, Kyoto, Japan

[21] Appl. No.: 09/177,563

[22] Filed: Oct. 23, 1998

[30] Foreign Application Priority Data

Dec. 25, 1997 [JP] Japan ..... 9-357956

[51] Int. Cl.[7] ..... D01H 7/46

[52] U.S. Cl. ..... 57/264; 57/88; 57/265; 57/334; 57/336

[58] Field of Search ..... 57/264, 265, 88, 57/334, 336

[56] References Cited

U.S. PATENT DOCUMENTS

| | | | |
|---|---|---|---|
| 4,152,931 | 5/1979 | Mannhart | 57/265 |
| 4,158,284 | 6/1979 | Wehde | 57/265 |
| 4,209,778 | 6/1980 | Wehde et al. | 57/265 |
| 4,242,860 | 1/1981 | Wehde et al. | 57/265 |
| 5,099,640 | 3/1992 | Kobayashi et al. | 57/97 |
| 5,502,961 | 4/1996 | Tone et al. | 57/264 |
| 5,799,476 | 9/1988 | Bahlmann | 57/264 |

FOREIGN PATENT DOCUMENTS

| | | | |
|---|---|---|---|
| 2657525 | 6/1978 | Germany | 57/265 |
| 6-116824 | 4/1994 | Japan . | |
| 6-184848 | 7/1994 | Japan | 57/336 |

*Primary Examiner*—William Stryjewski
*Attorney, Agent, or Firm*—Armstrong, Westerman, Hattori, McLeland & Naughton

[57] ABSTRACT

To enable malfunctions in the spindle drive motors of an individual-spindle-drive type textile machine in which each spindle has a rotating member (a false twisting member 5) for twisting yarn and a motor 15 for rotating the rotating member to be easily determined, a driver 30 for controlling the rotational speed of the motor 15 for each spindle and an alarm means 44 for notifying operators of a malfunction in the driver 30 are provided for each spindle.

7 Claims, 6 Drawing Sheets

INDIVIDUAL-SPINDLE-DRIVE TYPE TEXTILE MACHINE

FIELD OF THE INVENTION

The present invention relates to an individual-spindle-drive type textile machine comprising-for each spindle a rotating member for twisting yarn and a motor for rotating the rotating member, and an example of such an individual-spindle-drive type textile machine is a false twisting machine capable of recognizing malfunction conditions in the control provided by a motor driver for a nip twister for each spindle.

BACKGROUND OF THE INVENTION

In a textile machine, such as a draw texturing machine, yarn from a creel stand is passed through a heater and subjected to predetermined twisting by a nip twister (false twisting member) for each spindle, and the twisted yarn is then cooled and wound by a winder.

The nip twister is driven by a pair of brushless motors for each spindle and the rotation of which is controlled by a single driver.

Such an individual-spindle-drive type textile machine uses a very large number of motors which makes it difficult to control all drivers.

It is thus an object of the present invention to provide an individual-spindle-drive type textile machine that solves the above problem and that enables malfunctions in the motor driver for each spindle to be found easily.

SUMMARY OF THE INVENTION

To achieve this object, the present invention provides an individual-spindle-drive type textile machine comprising for each spindle a rotating member for twisting yarn and a motor for rotating the rotating member, wherein a driver for controlling the rotational speed of the motor is provided for each spindle and wherein an alarm means for notifying operators of a malfunction in the driver is provided for each spindle.

The present invention also involves an individual-spindle-drive type textile machine wherein a yarn breakage detection means is provided for each spindle so that a detection signal from the yarn breakage detection means is input to the driver and, when yarn is broke, the driver stops the motor.

The present invention is, further, an individual-spindle-drive type textile machine wherein the driver emits an alarm in the event of a yarn breakage or a malfunction in the driver using the various flashing conditions of an alarm member of the alarm means so that the nature of the malfunction can be. identified.

DETAILED DESCRIPTION OF THE PREFERRED EMBODIMENTS

A preferred embodiment of the present invention is described below in detail with reference to the accompanying drawings.

Figure 6:
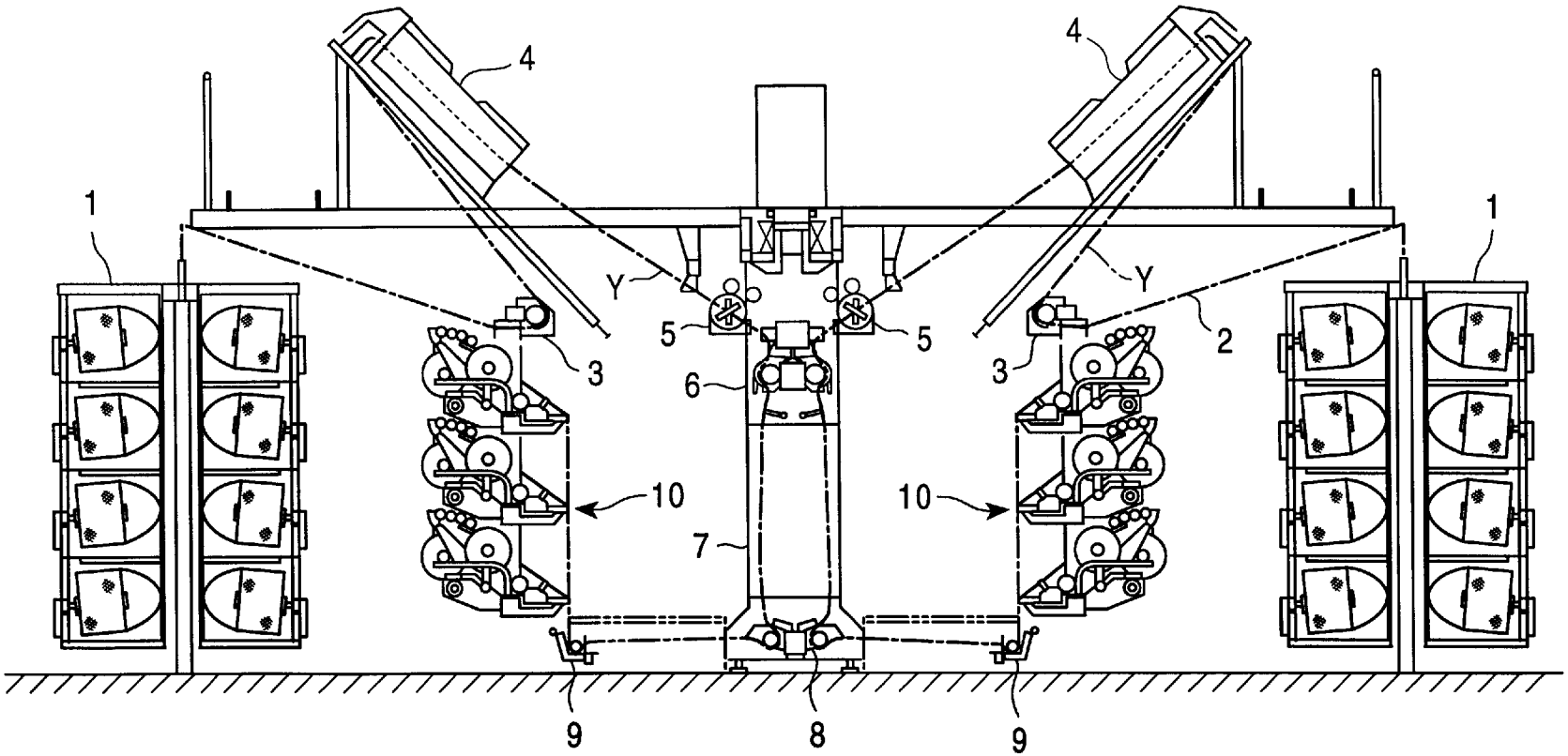
FIG. 6 shows the entire configuration of an individual-spindle-drive type textile machine according to the present invention.

First, the entire configuration of an individual-spindle-drive type textile machine according to the present invention is described with reference to FIG. 6.

Yarn Y from a creel stand 1 passes through a first feed roller 3 via a guide 2 and is heated by a first heater 4 and twisted by a nip twister (a false twisting member) 5, and the yarn Y then passes through a second heater 7 via a second feed roller 6 and is wound by a winder 10 via a third feed roller 8 and an oiling roller 9 to form a package P.

Figure 4:
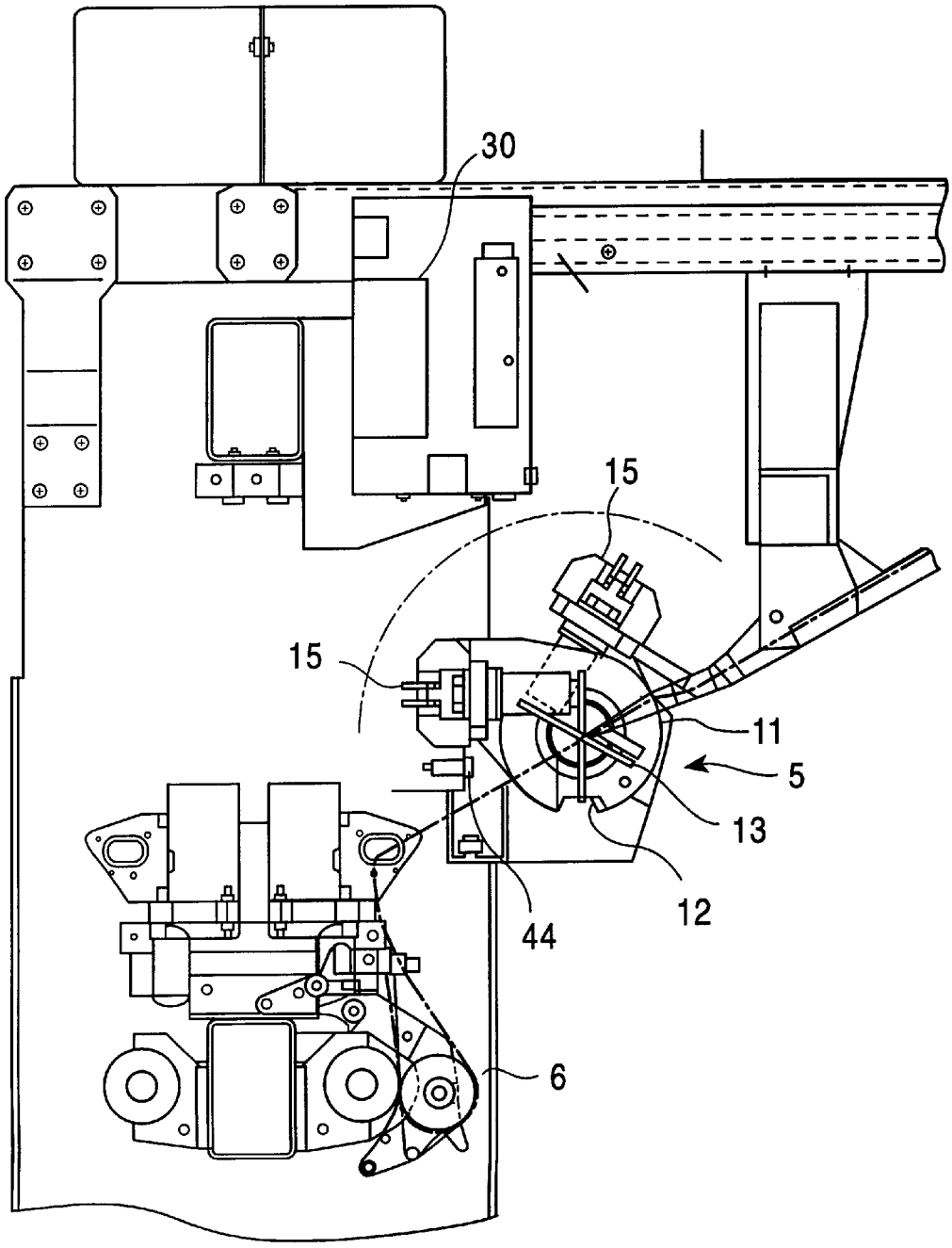
FIG. 4 shows details of a false twisting member according to the present invention.
Figure 5:
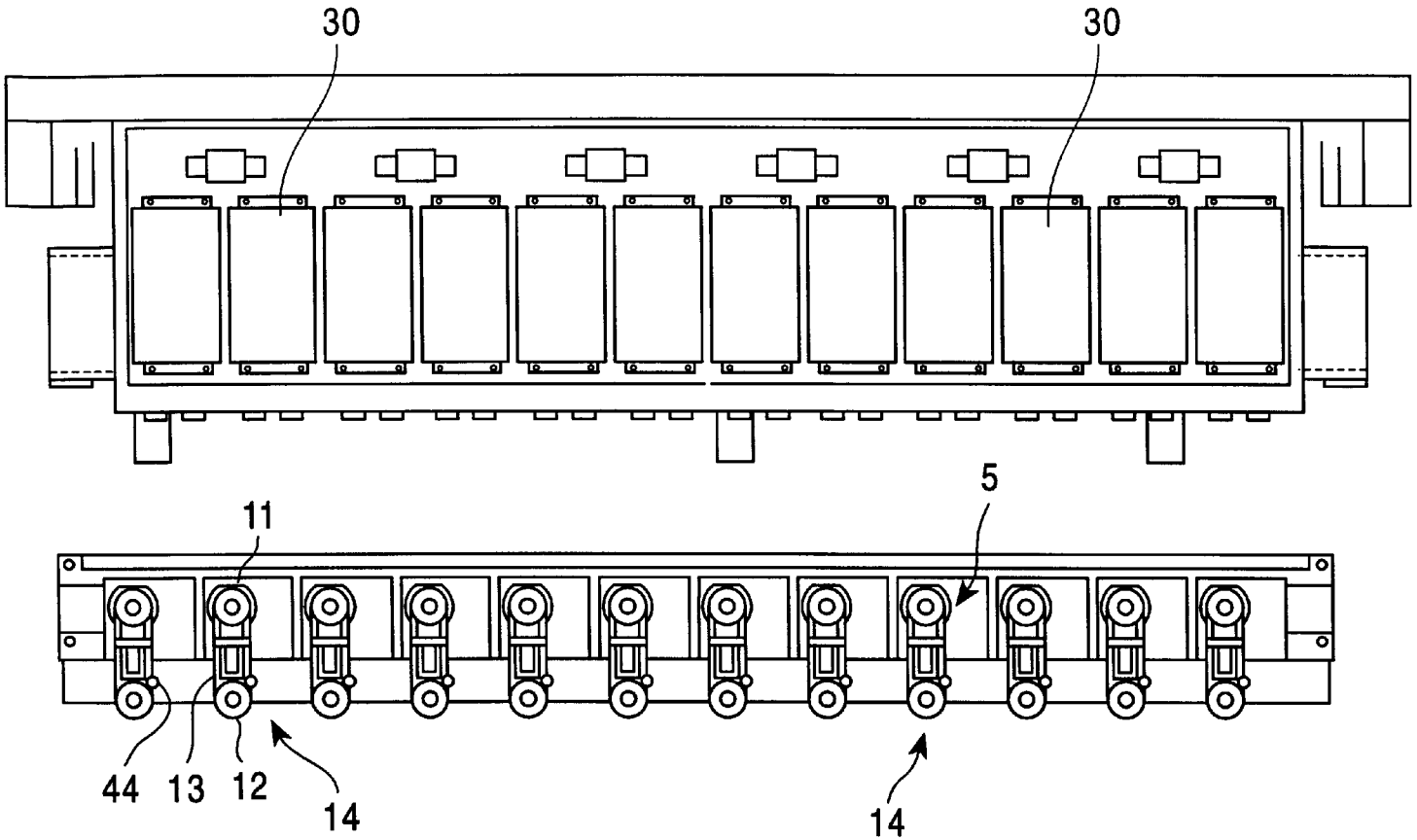
FIG. 5 is a right side view of FIG. 4.

The false twisting member 5 comprises a twisting belt 14 including belt 13 wound around a driving roller 11 and a driven roller 12 in such a way as to cross each other, as shown in FIGS. 4 and 5. Brushless motors 15, 15 are connected to the driving rollers 11, 11.

The pair of brushless motors 15, 15 are driven by a driver 30 provided for each spindle, as shown in FIG. 5, in such a way that the number of rotations can be varied.

Figure 3:
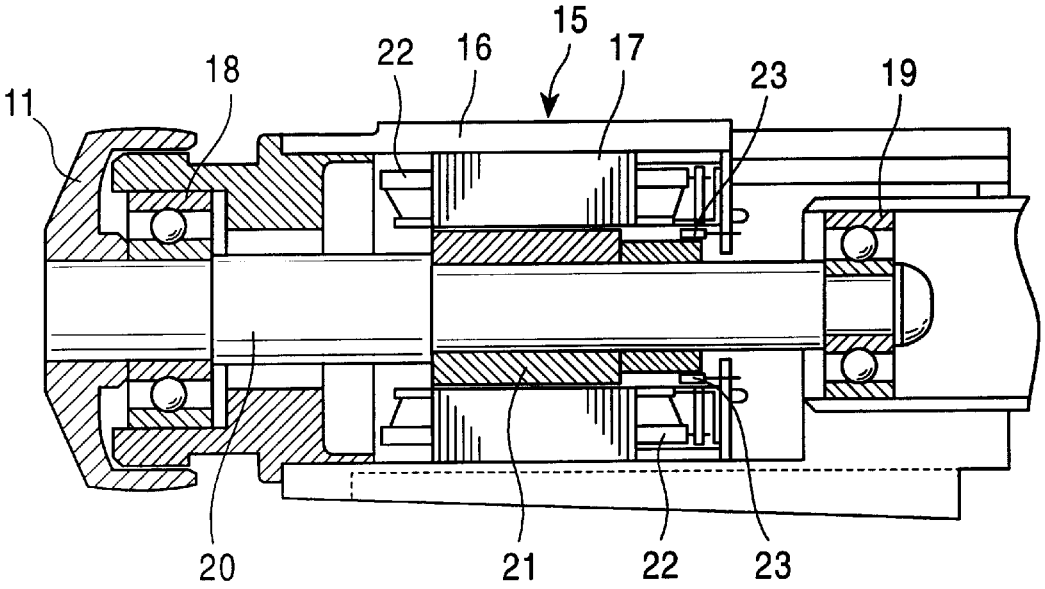
FIG. 3 is a sectional view of a brushless motor as shown in FIG. 1.

Next, an approximate configuration of the brushless motor 15 is described with reference to FIG. 3.

A stator 17 is mounted in a casing 16. Bearings 18, 19 provided in front of and behind the casing 16 rotatably bear a motor shaft 20, and a rotor 21 comprising a permanent magnet is provided on the motor shaft 20 in such a way as to be opposed to the stator 17. Bipolar windings 22 of U, V, and W phases are wound round the stator 17.

The stator 17 has along its circumferential direction a commutation sensor (a CS sensor) 23 for detecting magnetic flux from the rotor 21 and, in synchronism with the rotation, controlling a transistor for the driver 30 by turning the transistor on and off.

The driving roller 11 for the false twisting member 5 is attached to the tip of the motor shaft 20.

Figure 1:
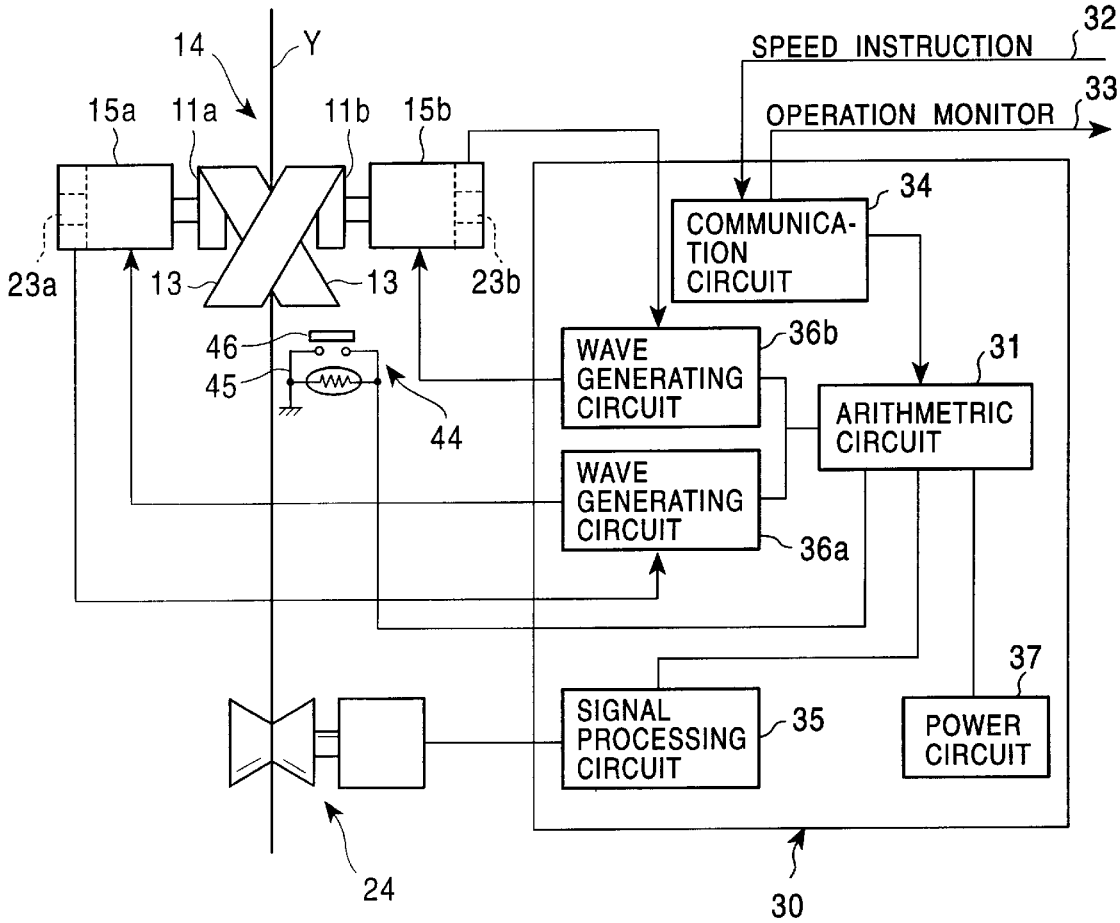
FIG. 1 is a schematic representation showing one embodiment of the present invention.
Figure 2:
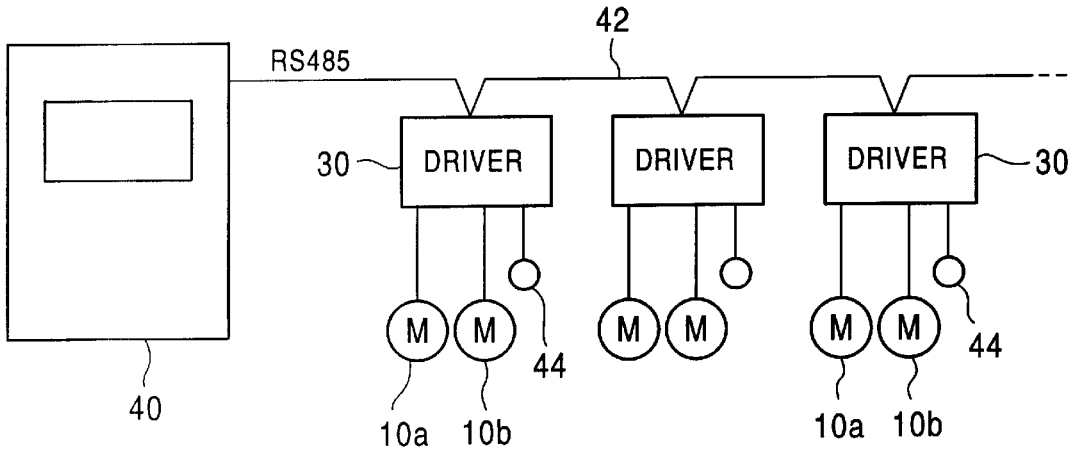
FIG. 2 is a schematic representation showing the entire system in FIG. 1.

As shown in FIG. 1, the driver 30 drives a brushless motor 15*a* that rotates clockwise and a brushless motor 15*b* that rotates counterclockwise so that the motors 15*a*, 15*b* rotate driving rollers 11*a*, 11*b* to drive the belts 13 in order to twist the yarn Y, and on the downstream side, the untwisting tension of the yarn Y is detected by a tension sensor 24 that uses a strain gauge. The detected value from the tension sensor 24 is input to the driver 30 so that the driver 30 can fine tune the number of rotations of the brushless motors 15*a*, 15*b*.

The driver 30 comprises an arithmetic circuit 31 including a CPU, a communication circuit 34 to which a speed instruction value 32 is input and which transmits an operational condition, such as a tension to, an operation monitor 33, a signal processing circuit 35 to which the detected value from the tension sensor 24 is input, wave generating circuits 36*a*, 36*b* to which detected values from CS sensors 23*a*, 23*b* are input and which output to the brushless motors 15*a*, 15*b* a PWM wave comprising a three phase alternating current, and a power circuit 37.

The driver 30 is provided slightly above the nip twister 5 for each spindle of the draw texturing machine, as shown in FIG. 5, and each driver 30 is connected to a control apparatus 40 through a communication line 42 to send and receive the above speed instruction and the operational condition.

According to the present invention, an alarm means 44 for notifying operators of a malfunction in the driver 30 or a yarn breakage is connected to the arithmetic circuit 31 of the driver 30 for each spindle. The alarm means 44 comprises an alarm member 45, such as a lamp, and a switch member 46 for canceling the flashing of the alarm member 45 as shown in FIG. 1.

Possible malfunctions in the driver 30 include uncontrolled operation of the CPU for the arithmetic circuit 31, an external alarm or a communication malfunction transmitted through the communication line 42, an over or under voltage from the power circuit 37, overload and malfunctions in motor speed, and a yarn breakage or abrasion of the belt 13 is detected based on a detected value from the tension sensor 24 or a load current and is transmitted to a host control apparatus 40 through the communication line 42. It is also indicated by the flashing condition (the number or duration of flashes) of the alarm member 45 so that an operator can recognize the nature of the malfunction by observing the flashes. The operator can also cancel the flashing by pressing the switch member 46.

The alarm means 44 is located near the false twisting member 5 for each spindle as shown in FIGS. 4 and 5 so that the operator can determine in which spindle a malfunction has occurred, by looking at the alarm means 44.

Next, the operation of the present invention is described.

While the false twisting member 5 is twisting the yarn Y, the tension sensor 24 detects the untwisting tension and the detected value is input to the signal processing circuit 35. Based on this value, the arithmetic circuit 31 controls, via the wave generating circuits 36*a,* 36*b,* the phase of power supplied to each motor in order to control the rotational speeds of the brushless motors 15*a,* 15*b.*

In this case, if, for example, the yarn becomes broken, the untwisting tension detected by the tension sensor 24 decreases below a set value. Accordingly, the arithmetic circuit 31 can easily determine that the yarn breakage has occurred and cause the alarm member 45 of the alarm means 44 to light while stopping the rotation of the brushless motors 15*a,* 15*b.*

Consequently, the operator can determine in which spindle a yarn breakage has occurred. A yarn breakage may also be detected based on an increase in load current.

In addition, each type of malfunction concerning the driver 30, for example, a malfunction in the power circuit 37 or the signal processing circuit 35, corresponds to a unique malfunction condition. The arithmetic circuit 31 detects this condition, identifies the type of the malfunction, and causes the alarm member 45 to light a predetermined number of times while transmitting the nature of the malfunction to the control apparatus 40 through the communication line 42.

In this manner, various types of controls can be reliably provided by transmitting an operational condition, such as a yarn breakage or a malfunction in the driver 30, to the control apparatus 40, or by emitting an alarm using the alarm means 44.

According to the present embodiment, the plurality of nip twisters 5 are arranged in a line in the horizontal direction and the plurality of drivers 30 that drive the respective nip twisters 5 are arranged near the respective nip twisters 5 in a line in the horizontal direction in such a way that the distances from the drivers to the corresponding nip twisters 5 are approximately equal, as shown in FIG. 5. If the distances from the drivers to the corresponding motors for the rotating members for twisting the yarn are approximately equal as described above, the use of simple wiring enables each motor to be controlled accurately without being affected by voltage drop or noise.

Although a draw texturing machine having a pair of crossing belts has been assumed here as the individual-spindle-drive type textile machine, the present invention is applicable to such a machine with a large number of motors and drivers for rotating members provided in parallel, such as a spinning machine for twisting yarn using a pair of crossing balloon rollers or a multi twisting machine for twisting yarn using the rotation of spindles.

In summary, the present invention provides an individual-spindle-drive type textile machine that enables malfunctions in the driver for each spindle or a yarn breakage to be detected easily even if a large number of drivers are installed for driving rotating members.

What is claimed is:

1. An individual-spindle-drive type textile machine comprising for each respective spindle cooperating rotating members for twisting yarn and a motor for rotating each rotating member, characterized in that the machine comprises a yam breakage detection mechanism for detecting yarn breakage during winding for each respective spindle, an alarm member provided for each respective spindle so as to be lighted, and a driver operative for controlling the rotational speed of each said motor for each respective rotating member and being operative for controlling a lighting state of said alarm member for each respective spindle, and in that said driver is operative to notify of at least two machine malfunctions, including yarn breakage, overload on any of said motors, and malfunction in the driver, by using a different lighting state of said alarm member corresponding with each respective malfunction.

2. An individual-spindle-drive type textile machine as in claim 1 characterized in that an operational status including a yarn breakage and the status of a malfunction in the driver are transmitted to a host-side control apparatus via a communication line.

3. An individual-spindle-drive type textile machine comprising for each respective spindle a false twisting apparatus comprising a pair of belts in contact with each other in such a way as to intersect each other, the textile machine also comprising, for each respective spindle, a motor for driving each of the belts, characterized in that the machine comprises a yarn breakage detection mechanism for detecting yarn breakage during winding for each respective spindle, an alarm member provided for each respective spindle so as to be lighted, and a driver for controlling the rotational speed of each said motor for each respective belt and for controlling a lighting state of said alarm member for each respective spindle, in that said driver is operative to notify of at least two machine malfunctions including yarn breakage, overload on the motor, and malfunction in the driver by using a different lighting state of said alarm member corresponding with each respective malfunction, and in that each said motor is immediately stopped when a detection signal from the yam breakage detection mechanism is input.

4. An individual-spindle-drive-type textile machine as in claim 3 characterized in that the motor for driving the belts includes a motor provided for each belt of the pair of belts, and in that both motors are controlled by a common arithmetic circuit in the driver.

5. An individual-spindle-drive type textile machine as in claim 3 or claim 4 characterized in that said driver detects a yarn breakage when tension detected by a tension sensor for measuring untwisting tension decreases below a set value.

6. An individual-spindle-drive type textile machine as in any one of claims 3 or 4 characterized in that said driver detects a yam breakage when the load current values of the respective motors increase.

7. An individual-spindle-drive type textile machine as in claim 5 characterized in that said driver detects a yarn breakage when the load current values of the respective belt-driving motors increase.

* * * * *